United States Patent [19]

Eckles

[11] 4,384,930

[45] May 24, 1983

[54] ELECTROPLATING BATHS, ADDITIVES THEREFOR AND METHODS FOR THE ELECTRODEPOSITION OF METALS

[75] Inventor: William E. Eckles, Cleveland Heights, Ohio

[73] Assignee: McGean-Rohco, Inc., Cleveland, Ohio

[21] Appl. No.: 294,976

[22] Filed: Aug. 21, 1981

[51] Int. Cl.[3] ..... C25D 3/22; C25D 3/26; C25D 3/38; C25D 3/60

[52] U.S. Cl. ..... 204/43 S; 204/45 R; 204/50 R; 204/52 R; 204/53; 204/54 R; 204/55 R; 204/DIG 2

[58] Field of Search ..... 564/505; 562/564; 204/45 R, 45 A, 45.5, 46 R, 46 G, 47, 48, 49, 50 R, 50 Y, 51, 52 R, 52 Y, 53, 54 R, 54 L, 55 R, 55 Y, 43 R, 43 Z, 43 G, 43 S, 43 T, 43 N, 43 P, 44, DIG. 2

[56] References Cited

U.S. PATENT DOCUMENTS 4,135,991 1/1979 Canaris et al. ..... 204/43 S 4,235,811 11/1980 Schulze et al. ..... 564/505 X

*Primary Examiner*—G. L. Kaplan

*Attorney, Agent, or Firm*—Maky, Renner, Otto & Boisselle

[57] ABSTRACT

Bright level metal deposits can be obtained on substrates from aqueous acid plating baths containing water soluble salts of the metal to be deposited and at least one surfactant of the formula $$ROCH_2CH(CH_3)OCH_2CH(CH_3)N(H)CH_2CH_2COOH \quad (I)$$

or $$ROCH_2CH(CH_3)OCH_2CH(CH_3)N\begin{matrix}(CH_2CH_2O)_xH \\ (CH_2CH_2O)_yH\end{matrix} \quad (II)$$

wherein R is an alkyl group containing 10 to 12 carbon atoms; x and y are integers, the sum of which is from 2 to about 20. The aqueous acid plating baths of the invention will preferably contain as a brightening agent, at least one carbonyl-containing compound. These plating baths exhibit low foaming characteristics.

33 Claims, No Drawings

ELECTROPLATING BATHS, ADDITIVES THEREFOR AND METHODS FOR THE ELECTRODEPOSITION OF METALS

BACKGROUND OF THE INVENTION

This invention relates to acidic electroplating baths and, more particularly, relates to the electrodeposition or electroplating of metals.

The electrodeposition of metals from aqueous solutions of the metal ions is well known. The present invention is concerned particularly with aqueous acid electroplating baths for depositing metals such as tin, lead, copper, zinc, cadmium or tin-lead mixtures. The composition of the metal electroplating bath will be determined at least in part by the particular metal to be electrodeposited. Various additives have been proposed in the art for improving the effectiveness of electroplating baths containing various metals.

In acidic electroplating baths, it is conventional to utilize a surfactant therein to control properties of the metal deposit and to assist in solubilizing other organic components. A wide variety of compositions have been suggested as surfactants in acid electroplating baths, and many of these are commercially available polyethylene oxide-based materials, and, therefore, typically contain a hydrophilic and hydrophobic portion within their chemical structure.

The present invention is directed particularly to improved aqueous acidic plating baths for depositing tin and/or lead coatings. Generally, these plating baths contain, in addition to the water-soluble tin and/or lead salts, at least one group selected from the group consisting of fluoborates, fluosilicates, sulfates, sulfamates, etc. In addition to these basic ingredients, the prior art has suggested improvements in such baths by including additives which will improve the brightness of the deposit obtained from such baths. In U.S. Pat. No. 3,875,029, the use of a naphthalene monocarboxyaldehyde either alone or in combination with certain substituted olefins described in the patent results in an improvement in the brightness of the deposit. Other ingredients which have been suggested as being useful additives in tin and/or lead plating baths include various combinations of carbonyl-containing compounds such as aldehydes, ketones and carboxylic acids, etc. For example, U.S. Pat. No. 3,749,649 describes the advantages of utilizing tin-lead plating baths containing at least one polyether surfactant and at least one aromatic aldehyde containing a chloro substituent. Another bath for producing bright deposits of tin-lead alloys is described in U.S. Pat. No. 3,785,939.

Typically, acid zinc plating baths have been based on a suitable inorganic zinc salt such as zinc sulfate or zinc chloride, and other additives to promote and improve ductility, brightness, throwing power and covering power. Surface active agents may be included to improve crystal structure, reduce pitting and increase the solubility of other additives.

Aromatic carbonyl-containing compounds generally are incorporated into acid zinc baths as a supplemental brightener additive and for improving fineness of the grain of the zinc deposit. Wetting agents or surfactants have been added to these baths to solubilize or improve the solubility of the carbonyl-containing compounds in the baths, but such wetting agents and surfactants generally result in a bath exhibiting a tendency to foam excessively, particularly on agitation with air.

A variety of plating baths have been developed and employed for electroplating cadmium onto metallic substrates. These baths typically utilize sulfates and cyanides as the primary electrolytes. The cyanide baths have proven effective and generally satisfactory despite certain objectionable features such as high toxicity, low current efficiency and hydrogen embrittlement of certain steels. The sulfate baths which have been suggested overcome many of the objectionable features of the cyanide baths. However, some of the sulfate-based baths contain such components as ammonium ions and chelating agents. Because of the ability of these agents to complex with heavy metal ions, there is a significant increase in the difficulty of eliminating heavy metals from spent baths. Sulfate-based baths which do not utilize ammonium ions or chelating agents have more recently been suggested in the prior art. For example, in U.S. Pat. No. 3,998,707, an aqueous acidic cadmium electrolytic bath composition is described which comprises cadmium ions, free acid, and a particular surfactant combination which comprises a cationic polyoxyalkylated amine and an anionic surfactant. Preferably the cadmium plating bath also contains at least one brightener. Examples of brighteners include aryl aldehydes such as anisic aldehyde, ring halogenated aryl aldehydes such as ortho-chlorobenzaldehyde, heterocyclic aldehydes such as thiophenaldehyde, aryl olefinic conjugated ketones such as benzylidine acetone, and heterocyclic carboxylic acids such as nicotinic acid. U.S. Pat. No. 4,045,305 describes cadmium plating baths which contain cadmium ions, free acid, a surfactant combination comprising a condensed naphthalene sulfonate compound and a non-ionic polyoxyalkylated surfactant. Preferably this bath also contains a brightener of the type described in U.S. Pat. No. 3,998,707.

Acid copper plating baths for producing a brilliant copper finish on articles have been known in the art, and a number of patents have described various brightening agents which can be added to acidic copper baths. Examples of such patents include U.S. Pat. Nos. 2,707,166; 2,707,167; 2,830,014; 3,276,979 and 3,288,690. In U.S. Pat. No. 3,725,220 it has been suggested that the utilization of organic sulfonates or carboxylates as brightening additives in acid aqueous copper plating baths results in improved stability of the bath and effective deposition of copper over a satisfactory current density range.

In a number of instances in the prior art acid copper plating baths, a sufficiently brilliant finish is obtained but little or no smoothing effect on the surface is obtained. The ability of a plating bath to produce deposits relatively thicker in small recesses and relatively thinner on small protrusions thereby decreasing the depth of surface irregularities is known as "leveling". For example, a copper plating bath with satisfactory leveling ability can be utilized to reduce or eliminate the effect of microscopic cracks or scratches on the surfaces of the articles being plated. Accordingly, a number of additives have been described in the prior art for increasing the leveling effect of acid copper plating baths. For example, U.S. Pat. No. 3,101,305 describes a leveling additive obtained from the condensation of thiourea with aliphatic aldehyde such as formaldehyde. Since the additives which have been described in the prior art are useful either as brightening agents or leveling agents, it generally has been necessary to utilize two additives in acid copper plating baths, one for brightness and another for leveling.

SUMMARY OF THE INVENTION

The present invention relates to the discovery that bright level metal deposits can be obtained on substrates from aqueous acid plating baths containing water soluble salts of the metal to be deposited and at least one surfactant of the formula $$ROCH_2CH(CH_3)OCH_2CH(CH_3)N(H)CH_2CH_2COOH \quad (I)$$

or $$ROCH_2CH(CH_3)OCH_2CH(CH_3)N\begin{matrix}(CH_2CH_2O)_xH \\ (CH_2CH_2O)_yH\end{matrix} \quad (II)$$

wherein R is an alkyl group containing 10 to 12 carbon atoms; x and y are integers, the sum of which is from 2 to about 20. The aqueous acid plating baths of the invention which each preferably contain as a brightening agent, at least one carbonyl-containing compound, exhibit low foaming characteristics.

Generally, the acid plating baths of the invention will contain as the metal ions to be plated, zinc, cadmium, tin, lead, copper, and tin-lead mixtures. Other additives normally included in aqueous acid plating baths such as wetting agents, etc., can be included in the plating baths of the invention. The invention also relates to a method of electrodepositing the above metals on substrates and to additive compositions useful in the preparation of aqueous acid plating baths.

DESCRIPTION OF THE PREFERRED EMBODIMENTS

In the practice of the present invention, the metal ions contained in the aqueous acid plating baths are preferably divalent or polyvalent metal ions. The divalent metal ions such as copper, zinc, cadmium, tin, lead or tin-lead mixtures are preferred. Mono and trivalent metals such as silver, chromium and gold also may be included in the plating baths of the invention.

The electroplating bath compositions of the present invention comprise an aqueous solution of the metal to be plated, and as a surfactant, at least one compound of the formula $$ROCH_2CH(CH_3)OCH_2CH(CH_3)N(H)CH_2CH_2COOH \quad (I)$$

or $$ROCH_2CH(CH_3)OCH_2CH(CH_3)N\begin{matrix}(CH_2CH_2O)_xH \\ (CH_2CH_2O)_yH\end{matrix} \quad (II)$$

wherein R is an alkyl group containing 10 to 12 carbon atoms; x and y are integers, the sum of which is from 2 to about 20. The plating baths also will contain pH adjusters and one or more additives including brighteners, buffering agents, levelers, wetting agents, etc., which are intended to improve the performance or life of the bath, the quality of the metal deposit and/or to impart other beneficial effects. It is common in electroplating art to utilize many and varied additives which are selected according to the particular system being used, including the type of metal to be deposited. The use of such supplementary additives in the electroplating bath compositions of the present invention in order to adapt the compositions to particular circumstances are included within the scope of the present invention.

The metal ions to be deposited are incorporated into the aqueous acidic plating baths in the form of their bath-soluble salts such as the salts of hydrochloric acid, sulfuric acid, fluoboric acid, boric acid, etc.

The surfactant utilized in the plating baths of the invention can be characterized by one of the following formulas $$ROCH_2CH(CH_3)OCH_2CH(CH_3)N(H)CH_2CH_2COOH \quad (I)$$

or $$ROCH_2CH(CH_3)OCH_2CH(CH_3)N\begin{matrix}(CH_2CH_2O)_xH \\ (CH_2CH_2O)_yH\end{matrix} \quad (II)$$

wherein R is an alkyl group containing 10 to 12 carbon atoms, x and y are integers, the sum of which is from 2 to about 20.

The surfactant represented by formula I is amphoteric, and depending upon the pH of the plating bath, it will show either cationic or anionic properties.

The amine ethoxylate surfactants of the type represented by formula II exhibit the characteristics of both cationic and nonionic surfactants with the nonionic properties increasing at the higher levels of ethoxylation. That is, as the sum of x and y increases, the ethoxylated amine behaves more like a nonionic surfactant.

The surfactants represented by formulas I and II are available commercially from Texaco Chemical Company under the trade designation "MA300" and "M-300 Series" respectively. The M-300 Series compounds currently available from Texaco and which have been found to be useful in the aqueous acid plating baths of the invention include those designated as M-302, M-305, M-310, M-315 and M-320 which contain a total of two, five, ten, fifteen and twenty moles of ethylene oxide respectively. In all of these compounds, R is a mixture of 10 and 12 carbon alkyl groups.

The amount of the amine derivative surfactant represented by formula I and II incorporated in the aqueous acidic plating baths of the invention can vary over a wide range depending upon the nature and composition of the plating bath. Generally, however, the plating bath will contain from about 0.5 to about 15 grams or more of the surfactants I and II per liter of plating bath.

The aqueous acidic plating baths of the invention can be prepared according to conventional techniques by simply dissolving the desired ingredients into a given quantity of water. The metal to be plated is added to the water in the form of a water soluble salt such as a metal sulfate, chloride, phosphate, citrate, carbonate or acetate. The amine surfactants represented by formulas I and II may be added directly to the plating baths as such or they may be prereacted through either the hydroxyl functions or the amine group to form bath soluble esters, salts, quaternary ammonium compounds, etc., which then may be added to the plating baths.

In one preferred embodiment, the plating baths also contain at least one compound which will enhance the brightness of the deposit. A variety of compositions have been suggested as being useful as brightener compositions in the electroplating art, and any of these may be included in the plating baths of the invention. The particular choice of brightener composition will be made in accordance with the particular electroplating system being utilized.

The most widely used brightening compounds in aqueous acid plating baths are carbonyl-containing compounds which may be either aromatic carbonyl-containing compounds or aliphatic carbonyl-containing compounds. Among the useful carbonyl-containing compounds are the aldehydes, ketones, carboxylic acids and bath soluble salts of carboxylic acids. Mixtures of more than one type of carbonyl group often is advantageous, and such a mixture would include the mixture of a bath-soluble salt of benzoic acid and an aromatic ketone.

The plating baths of the invention may contain at least one aldehyde which may be an aliphatic aldehyde, an aromatic aldehyde, or mixtures of such aldehydes. The aliphatic aldehydes which are particularly useful in the plating baths of the invention are those containing up to about four carbon atoms and these include, for example, formaldehyde, acetaldehyde, propionaldehyde, butyraldehyde, crotonaldehyde, and 3-hydroxybutanal. Up to about 25 grams per liter of the aliphatic aldehyde may be included in the baths and preferably, from about one to about 25 grams per liter of the aliphatic aldehyde is utilized.

Preferred examples of the aromatic aldehydes which have been found useful are the naphthaldehydes and benzaldehydes. It is preferred that the benzaldehydes contain at least one chloro substituent. Examples of aromatic aldehydes which may be utilized in the plating baths of the invention include o-chlorobenzaldehyde; 2,4-dichlorobenzaldehyde; 3,4-dichlorobenzaldehyde; 3,5-dichlorobenzaldehyde; 2,6-dichlorobenzaldehyde; tolualdehyde; 3,4-dimethoxybenzaldehyde; cinnamaldehyde; and anisaldehyde. Examples of the naphthaldehydes include 1-naphthaldehyde; 2-naphthaldehyde; 2-methoxy-1-naphthaldehyde; 2-hydroxy-1-naphthaldehyde; 2-ethoxy-1-naphthaldehyde; 4-methoxy-1-naphthaldehyde; 4-ethoxy-1-naphthaldehyde; and 4-hydroxy-1-naphthaldehyde. In some applications, a combination of the naphthaldehyde with a benzaldehyde such as 1-naphthaldehyde with 2,6-dichlorobenzaldehyde provides a superior deposit on the substrates. Examples of other carbonyl compounds includes ketones which may include aliphatic ketones such as acetone and methyl ethyl ketone, and aromatic ketones such as benzylidene acetone, coumarin, acetophenone, propiophenone, 3-methoxybenzol acetone. Other carbonyl compounds include furfurylidine acetone, 3-indole carboxyaldehyde and thiophene carboxyaldehyde.

Mixtures of aliphatic aldehydes and the above-described aromatic aldehydes and mixtures of naphthaldehydes and benzaldehydes have been found to be particularly useful. Examples of suitable combinations include: the mixture of acetaldehyde and 4-methoxy-1-naphthaldehyde; the mixture of formaldehyde, 1-naphthaldehyde, and 2,6-dichlorobenzaldehyde; etc.

Examples of useful carboxylic acids and salts, ester, amides, include benzoic acid, sodium salicylate, 3-pyridine carboxylic acid, benzamide, ethyl benzoate, propyl benzoate. The benzoic and salicylic acids and salts are preferred.

Mixtures of one or more of the aldehydes with one or more ketones also are useful. When employed in the baths of the invention, the carbonyl-containing brighteners will be included within the range of from about 0.02 to about 10 grams per liter and preferably from about 0.03 to about 1 gram per liter of bath.

Pyridine compounds also are useful as brighteners, particularly in acid cadmium plating baths.

The pyridine compounds which are the preferred brighteners in the plating baths of the invention have the formula

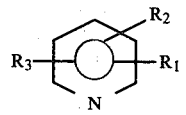

III wherein $R_1$, $R_2$ and $R_3$ are each independently hydrogen, alkyl, alkoxy, alkene, mercapto, amino, halogen, aryl, arylalkyl, aminoalkyl, hydroxy, hydroxyalkyl, cyano, dialkylamide, aldoxime, benzo (b), pyrrolidinyl groups and the corresponding N-oxide compounds. The alkyl, alkoxy and alkene groups will generally be lower alkyl, alkoxy or alkene groups containing up to six carbon atoms. The aryl groups may contain one or more groups attached to the aromatic moiety including lower alkyl, hydroxy, amino and halogen groups.

The pyridine compounds of the type represented by formula III are available and well known compounds. For example, most of the compounds listed in Table I below are available from the Aldrich Chemical Company, Milwaukee, Wis. Mixtures of the pyridine compositions may be included in the plating baths. The amount of pyridine composition included in the cadmium baths of the invention is an amount which is effective to provide a bright or semi-bright and level cadmium deposit as desired. Generally amounts of from about 0.05 to 10 grams per liter of bath will provide satisfactory semi-bright to bright deposits over a wide current density.

TABLE I

Pyridine Brightener Compounds
4-pyridine aldoxime
3,4-dimethylpyridine
4-benzylpyridine
3-bromopyridine
Quinoline (Benzo (b) pyridine)
Quinaldine
3-picoline-N-oxide
2-aminopyridine
3-aminopyridine
2,6-diaminopyridine
3-picoline
4-picoline
3-aminomethylpyridine
2-amino-4-picoline
2-amino-3-hydroxy-pyridine
3-chloropyridine
3,5-dichloropyridine
4-tert-butylpyridine
4-bromopyridine
3-cyanopyridine
N,N-diethylnicotinamide pyridine
2,6-dimethoxypyridine
3-hydroxypyridine
4-vinylpyridine
4-methoxypyridine 3-pyridylcarbinol-N-oxide
3,5-lutidine
4-mercaptopyridine
2-methoxypyridine
2,4-lutidine
2,4,6-collidine
benzoyl pyridine Other materials which have been suggested in the art as brighteners for acid plating baths also can be used in the plating baths of the present invention. For example, U.S. Pat. No. 4,139,425 described brightener additive compositions for aqueous acidic tin, lead or tin-lead plating baths which are the reaction products of an unsaturated nitrogen-containing heterocyclic compound with a mixture of formaldehyde, an unsaturated aliphatic aldehyde, and, optionally, an aliphatic carboxylic acid. The unsaturated nitrogen-containing heterocyclic compounds preferably are imidazoles, pyrazoles, pyrazines or pyridines which may be substituted or unsubstituted. The disclosure of U.S. Pat. No. 4,139,425 is incorporated by reference.

Nitrogen and sulfur compositions are described as being useful as brightening and leveling additives for acid copper plating baths in U.S. Pat. No. 4,134,803. The nitrogen and sulfur compositions are prepared by reacting a mixture of a disulfide and a halo hydroxy sulfonic acid in an aqueous alkaline medium. These compositions are useful as brighteners and leveling agents in the plating baths of the present invention and particularly in the copper plating baths of the invention. Accordingly, the disclosure of U.S. Pat. No. 4,134,803 hereby is incorporated by reference.

Polymeric sulfur-containing compounds are described in U.S. Pat. No. 4,229,268 as being useful leveling and brightening additives for aqueous acidic zinc plating baths. The description of the polymeric sulfur-containing compositions in U.S. Pat. No. 4,229,268 hereby is incorporated by reference. As noted therein, the polymeric sulfur-containing compositions useful as brighteners are available commercially such as, for example, from Crucible Chemical Company, Greenville, S. Carolina. These compounds are available containing various ratios of ethylene and/or propylene oxide to hydrogen sulfide, 2-hydroxymethyl sulfide or mercaptan. One example of such a compound is Cru Peg HS-2000 which is believed to be the reaction product of one mole of hydrogen sulfide or 2-hydroxyethyl sulfide with 46 or 44 moles of ethylene oxide.

The properties of the metal deposits obtained from the bath of the invention, particularly the tin and/or lead deposits, may be improved in some instances by the inclusion of an aromatic amine in the bath. Generally, the bath may contain up to about 15 grams of aromatic amine per liter of bath. Examples of aromatic amines which are useful include aniline; o-toluidine; p-toluidine; m-toluidine; and o-chloroaniline.

The baths of the invention, particularly the tin and/or lead plating baths, also may contain small amounts of one or more chlorinated benzenes such as 1,2-dichlorobenzene; 1,2,4-trichlorobenzene; 1,2,3-trichlorobenzene and 1,3,5-trichlorobenzene. Amounts up to about 5 grams of the chlorinated benzene per liter of bath, and preferably from about 0.5 to about 3 grams per liter may be utilized.

The incorporation of one or more wetting or surface active agents into the additive compositions and acid plating baths of the invention also results in a plating with improved leveling and brightness, and the additive compositions and plating baths exhibit improved stability. Copper, tin, lead and tin-lead plating baths particularly are improved in the presence of a wetting agent.

Polyoxyalkylated naphthols are one type of wetting agent found to be useful in improving the quality of the metal deposits. Amounts of the substituted naphthol of up to about 1 gm. per liter and preferably from about 0.2 to about 0.8 gm. per liter provide improved metal deposits.

The polyoxyalkylated naphthols useful in the baths of this invention are obtained by reacting a naphthol with an alkylene oxide such as ethylene oxide and propylene oxide and more particularly, with from about 6 to about 40 moles of ethylene oxide per mole of naphthol. The naphthol reactant may be either alpha- or beta-naphthol and the naphthalene ring may contain various substituents such as the alkyl groups or alkoxy groups, especially lower alkyl and lower alkoxy groups of up to seven carbon atoms each, so long as the polyoxyalkylated naphthol remains bath-soluble. When present, there usually will not be more than two such substituents per polyoxyalkylated naphthol; that is, two lower alkoxy groups, two lower alkyl groups, or a lower alkyl or a lower alkoxy group. The preferred polyoxyalkylated naphthols are ethoxylated naphthols having the formula

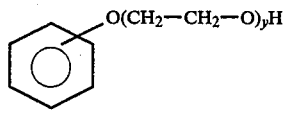

IV wherein y is from about the 6 to about 40 and preferably from about 8 to about 20.

Wetting agents based on ethylene oxide, for example, polyglycol compounds and the like, and sulfonated wetting agents also are useful. In general, the nonionic wettng agents such as those containing ether linkages are particularly useful additives. Examples of such ether-containing wetting agents are those having the general formula $$R—O—(CH_2CH_2O)_nH$$

wherein R is an aryl or alkyl group containing from about six to 20 carbon atoms and n is an integer between 2 and 100. Such wetting agents are produced generally by treating fatty alcohols or alkyl-substituted phenols with excess ethylene oxide. The alkyl carbon chain may contain from about 14 to 24 carbon atoms and may be derived from alcohol such as oleyl alcohol or stearyl alcohol. Nonionic polyethylene compounds of this type are described more completely in U.S. Pat. No. 3,855,085. Such compounds are available commercially under general trade designations such as "Surfynol" (Air Products and Chemicals, Inc.) and "Pluronic" or "Tetronic" (BASF Wyandotte).

Amine, alkanol amines, amides and polyglycol-type wetting agents known in the art are also useful. One type of amine wetting agent found particularly useful when combined with the nitrogen and sulfur composition of the invention in a copper plating bath is the group obtained by the addition of a mixture of propylene oxide and ethylene oxide to diamines. More specifically, compounds formed by the addition of propylene oxide to ethylene diamine followed by the addition of ethylene oxide are useful and are available commercially from BASF Wyandotte Ind. Chemical Group under the general trade designation "Tetronic".

Carbowax-type wetting agents which are polyethylene glycols having different molecular weights have been found to give good results. For example Carbowax No. 1000 has a molecular weight range of from about 950 to 1,050 and contains from 20 to 24 ethoxy units per molecule. Carbowax No. 4000 has a molecular weight range of from about 3000 to 3700 and contains from 68 to 85 ethoxy units per molecule. Other known nonionic glycol derivatives such as polyalkylene glycol ethers and methoxy polyethylene glycols which are available commercially can be utilized as wetting agents in the compositions of the invention. The amount of wetting agents incorporated into the compositions will depend upon types and amounts of other ingredients in the compositions, but generally from 0 to about 5.1 grams and preferably from 0.4 to about 1.5 grams per liter of the wetting agent may be incorporated into the compositions.

Other supplementary additives generally utilized in aqueous acidic metal electroplating baths can be utilized in the plating baths of the invention. Thus, supplementary additives which have been suggested in the art as being useful in, for example, zinc plating baths, can be utilized in combination with the amine surfactants of the present invention represented by formulas I and II described above, and, similarly, supplementary additives normally used in tin and/or lead electroplating baths can be utilized in combination with the amine surfactants of the invention in tin and/or lead plating baths.

Aromatic sulfonic acids or salts also are useful additives to the plating baths and these include the acids and salts having the general formula

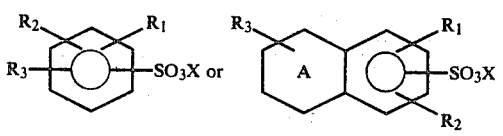

(V) (VI)

wherein $R_1$, $R_2$ and $R_3$ are each independently hydrogen or lower alkyl groups, X is hydrogen, ammonia or any metal with the proviso that the metal sulfonate is soluble in the bath, and A is a saturated unsaturated or aromatic ring.

As can be seen from the formulas, the sulfonic acids may be derived from benzene sulfonic acids, naphthalene sulfonic acids and di- or tetrahydronaphthalene sulfonic acids. The lower alkyl groups can be straight or branched chain and may contain up to about 6 carbon atoms. The aromatic sulfonic acids and salts of formulas V and VI containing two alkyl groups have been found to be particularly effective in the acid zinc plating baths of the invention. Of the metals included in the salts of the sulfonic acids, the alkali metals, particularly sodium, are preferred.

Examples of aromatic sulfonic acids which are useful particularly in the acid zinc plating baths of the invention include benzene sulfonic acid, toluene sulfonic acid, isopropylbenzene sulfonic acid, xylene sulfonic acid, diethylbenzene sulfonic acid, naphthalene sulfonic acid, methylnaphthalene sulfonic acid, dimethylnaphthalene sulfonic acid, tetrahydronaphthalene sulfonic acid, etc. The aromatic sulfonic acids preferably are added to the acid zinc plating baths in the form of their salts which may be metal salts or an ammonium salt. Any metal can be used to form the metal salts of the aromatic sulfonic acids so long as the metal does not cause any detrimental effects in the plating bath or render the sulfonates insoluble in the plating bath.

The aromatic sulfonic acids and salts which are utilized in the plating baths of the invention generally are referred to in the art as hydrotropes. Hydrotropes have been defined as compounds which solubilize sparingly water-soluble compounds. The aromatic sulfonic acids and salts used in the present invention are effective in solubilizing sparingly water soluble materials such as aromatic carbonyl-containing compounds, and it has been found that the acid zinc plating baths containing the above described aromatic sulfonic acids and salts are not subject to excessive foaming during plating operations. This is in contrast to plating baths wherein wetting agents and surfactants are used to stabilize the baths since such plating baths generally are characterized by excess foaming on use which requires careful control of plating methods. The plating baths of the invention, however, can be vigorously air agitated even at high current densities without excessive foaming.

The amount of aromatic sulfonic acid or salt incorporated into the plating baths of the invention may vary over a wide range, and the optimum amount for any particular plating bath combination can be determined readily by one skilled in the art. Generaly, the amount of sulfonic acid or salt included in the plating baths of the invention will vary from about one to about 20 or more grams per liter of bath. Greater or lesser amounts of the sulfonic acid or salts can be included in the plating baths depending particularly on the water solubility characteristics of the additive desired to be included in the bath.

Mixtures of the aromatic sulfonic acids or salts appear to be particularly effective in the acid zinc plating baths of the invention. More particularly, mixtures comprising at least one sulfonic acid or salt represented by formula V and at least one sulfonic acid or salt represented by formula VI are useful. An example of such a mixture is a mixture of sodium dimethylnaphthalene monosulfonate and sodium xylene monosulfonate.

Some examples of aromatic sulfonic acids which may be used include: a bath-soluble salt of tetrahydronaphthalene sulfonic acid such as those available commercially from DuPont; a bath-soluble salt of a xylene sulfonic acid such as those available from Arco Chemical Company under the general trade designation "Ultrawet"; and a bath-soluble salt of cumyl sulfonic acid.

The inclusion of the aromatic sulfonic acids and salts described above in plating baths generally improves the performance of most plating baths at a high current density range. Accordingly, the plating baths containing the sulfonic acids and salts are found to produce bright level metal plating over a current density range of from below 0.3 amps/dm$^2$ to above 12 amps/dm$^2$.

The following examples illustrate the plating baths of the invention. Unless otherwise indicated, all parts and percentages are by weight. In all of the following examples, the components identified are mixed with sufficient water to make one liter.

EXAMPLE 1

| Components | Concentration g/l |
|---|---|
| Stannous Sulfate | 45 |
| Sulfuric Acid | 200 |
| 1-naphthalene carboxaldehyde | 0.2 |
| Methacrylic Acid | 0.5 |
| Texaco M-302 (Formula II wherein x and y are each 1) | 4.0 |

EXAMPLE 2

| Components | Concentration g/l |
|---|---|
| Stannous Sulfate | 45 |
| Sulfuric Acid | 200 |
| 1-naphthalene carboxaldehyde | 0.2 |
| Methacrylic Acid | 0.5 |
| Texaco M-305 (Formula II wherein sum of x + y = 5) | 2.0 |

EXAMPLE 3

| Components | Concentration g/l |
|---|---|
| Stannous Sulfate | 45 |
| Sulfuric Acid | 200 |
| 1-naphthalene carboxaldehyde | 0.2 |
| Methacrylic Acid | 0.5 |
| Texaco M-310 (Formula II wherein sum of x + y = 10) | 2.0 |

EXAMPLE 4

| Components | Concentration g/l |
|---|---|
| Stannous Sulfate | 45 |
| Sulfuric Acid | 200 |
| 1-naphthalene carboxaldehyde | 0.2 |
| Methacrylic Acid | 0.5 |
| Texaco M-315 (Formula II wherein sum of x + y = 15) | 2.0 |

EXAMPLE 5

| Components | Concentration g/l |
|---|---|
| Stannous sulfate | 45 |
| Sulfuric Acid | 200 |
| 1-naphthalene carboxaldehyde | 0.2 |
| Methacrylic Acid | 0.5 |
| Texaco M-320 (Formula II wherein sum of x + y = 20) | 2.0 |

EXAMPLE 6

| Components | Concentration g/l |
|---|---|
| Stannous Sulfate | 45 |
| Sulfuric Acid | 200 |
| 1-naphthalene carboxaldehyde | 0.2 |
| Methacrylic Acid | 0.5 |
| Texaco MA-300 (Formula I) | 2.0 |

EXAMPLE 7

| Components | Concentration g/l |
|---|---|
| Stannous ion | 50 |
| Lead ion | 25 |
| Fluoboric Acid | 140 |
| Methoxynaphthaldehyde | 0.2 |
| Aniline | 1.5 ml |
| 1,2,4-trichlorobenzene | 1.0 |
| 2,6-dichlorobenzaldehyde | 0.05 |
| Texaco M-302 | 4.0 |

EXAMPLE 8

| Components | Concentration g/l |
|---|---|
| Stannous ion | 50 |
| Lead ion | 25 |
| Fluoboric Acid | 140 |
| Methoxynaphthaldehyde | 0.2 |
| Aniline | 1.5 ml |
| 1,2,4-trichlorobenzene | 1.0 |
| 2,6-dichlorobenzaldehyde | 0.05 |
| Texaco M-305 | 4.0 |

EXAMPLE 9

| Components | Concentration g/l |
|---|---|
| Stannous ion | 50 |
| Lead ion | 25 |
| Fluoboric Acid | 140 |
| Methoxynaphthaldehyde | 0.2 |
| Aniline | 1.5 ml |
| 1,2,4-trichlorobenzene | 1.0 |
| 2,6-dichlorobenzaldehyde | 0.05 |
| Texaco M-310 | 4.0 |

EXAMPLE 10

| Components | Concentration g/l |
|---|---|
| Stannous ion | 50 |
| Lead ion | 25 |
| Fluoboric Acid | 140 |
| Methoxynaphthaldehyde | 0.2 |
| Aniline | 1.5 ml |
| 1,2,4-trichlorobenzene | 1.0 |
| 2,6-dichlorobenzaldehyde | 0.05 |
| Texaco M-315 | 4.0 |

EXAMPLE 11

| Components | Concentration g/l |
|---|---|
| Stannous ion | 50 |
| Lead ion | 25 |
| Fluoboric Acid | 140 |
| Methoxynaphthaldehyde | 0.2 |
| Aniline | 1.5 ml |
| 1,2,4-trichlorobenzene | 1.0 |
| 2,6-dichlorobenzaldehyde | 0.05 |
| Texaco M-320 | 4.0 |

EXAMPLE 12

| Components | Concentration g/l |
|---|---|
| Stannous ion | 50 |

-continued

| Components | Concentration g/l |
|---|---|
| Lead ion | 25 |
| Fluoboric Acid | 140 |
| Methoxynaphthaldehyde | 0.2 |
| Aniline | 1.5 ml |
| 1,2,4-trichlorobenzene | 1.0 |
| 2,6-dichlorobenzaldehyde | 0.05 |
| Texaco MA-300 | 4.0 |

EXAMPLE 13

| Components | Concentration g/l |
|---|---|
| $ZnCl_2$ | 50 |
| KCl | 200 |
| Boric Acid | 30 |
| Benzylidene Acetone | 0.1 |
| Sodium xylene monosulfonate (Ultrawet 40SX) | 12 |
| Cru Peg HS-2000 | 5 |
| Benzoic Acid NaSalt | 2.5 |
| Texaco M-320 | 5 |

EXAMPLE 14

| Components | Concentration g/l |
|---|---|
| $CdSO_4$ | 30 |
| Sulfuric Acid | 80 |
| Pyridine | 2 |
| Alkanol TD (an alkyl aryl sulfonate from DuPont) | 1 |
| Texaco M-320 | 1 |

EXAMPLE 15

| Components | Concentration g/l |
|---|---|
| Copper Sulfate | 210 |
| Sulfuric Acid | 60 |
| N,N—dimethyldithiocarbamic acid-n-propylester-sodium sulfonate | 0.02 |
| Carbowax 1540 (polyethylene glycol wetting agent) | 2 |
| Texaco M-320 | 1 |

The utility of the above-described tin and/or lead plating baths is illustrated with a plating test conducted in a 267 ml. Hull Cell containing the above-described copper plating baths. The tin and/or lead is deposited on a scratched brass Hull Cell panel. The tin and/or lead plating baths of Examples 1–12 produce bright and level deposits over a current density range of from between about 0.2 amps/dm$^2$ to about 20 amps/dm$^2$ with mechanical agitation.

Similarly, the acid zinc plating bath of Example 13 yields a plated Hull Cell panel showing bright level zinc plate within a range of about 0.2 amps/dm$^2$ to about 20 amps/dm$^2$. Both the acid cadmium and acid copper electroplating baths of Examples 14 and 15 also yield Hull Cell panels plated in a 267 ml. Hull Cell which exhibit a wide current density range of bright electrodeposit.

The acid metal plating baths of the invention may be utilized to produce bright to semi-bright metal deposits on all types of metals and alloys, for example, on iron (cast or malleable), steel, copper and brass. The electroplating bath may be employed in all types of industrial plating baths including still plating baths, high speed plating baths for strip or wire plating, and in barrel plating.

The electroplating baths of the invention can be effectively operated within the conventional acid electroplating parameters. For example, in zinc plating with a chloride electrolyte, the optimum pH range is from about 5.0 to 5.5. For sulfate or fluoborate electrolytes such as used with cadmium, tin and tin/lead electroplating, lower pH's such as, for example, from about 0.5 to 1.5 produce excellent deposits. The temperature of the electroplating bath is maintained generally within a range of above the freezing point to below the boiling point of the bath although temperatures generally within a range of from about 25° C. to about 40° C. are preferred. The particularly beneficial plating bath temperature or any particular plating bath can be determined readily by one skilled in the art.

The plating baths of the invention may be operated on a continuous or intermittent basis, and from time to time, the components of the bath may have to be replenished. The various components may be added singularly as required or may be added in combination. The amounts of the various compositions to be added to the plating baths may be varied over a wide range depending on the nature and performance of the plating bath to which the composition is added. Such amounts can be determined readily by one skilled in the art. The following examples illustrate the additive compositions which can be used for preparing a bath or for addition to a working bath in accordance with the invention.

| | Percent by Volume |
|---|---|
| Additive Composition 1 | |
| 1-naphthalene carboxaldehyde | 2% |
| Methacrylic acid | 5% |
| Texaco M-302 | 40% |
| Methanol | 10% |
| Water | 43% |
| Additive Composition 2 | |
| 1-naphthalene carboxaldehyde | 2% |
| Methacrylic acid | 5% |
| Texaco MA-300 | 40% |
| Methanol | 10% |
| Water | 43% |
| Additive Composition 3 | |
| Methoxynaphthaldehyde | 4% |
| Aniline | 3% |
| Texaco M-315 | 80% |
| Methanol | 13% |

I claim:

1. An aqueous acidic electroplating bath composition comprising (a) at least one bath soluble divalent or polyvalent metal salt, and (b) at least one surfactant of the formula $$ROCH_2CH(CH_3)OCH_2CH(CH_3)N(H)CH_2CH_2COOH \quad (I)$$

or $$ROCH_2CH(CH_3)OCH_2CH(CH_3)N\begin{matrix}(CH_2CH_2O)_xH \\ (CH_2CH_2O)_yH\end{matrix} \quad (II)$$

wherein R is an alkyl group containing 10 to 12 carbon atoms;

x and y are integers, the sum of which is from 2 to about 20.

2. The electroplating bath of claim 1 wherein the metal of (a) is tin, lead, copper, zinc, cadmium or tin/-lead mixtures.

3. The electroplating bath of claim 1 wherein the metal is tin or a tin/lead mixture.

4. The electroplating bath of claim 1 wherein the metal is zinc.

5. The electroplating bath of claim 1 wherein the metal is cadmium.

6. The electroplating bath of claim 1 wherein the metal is copper.

7. An aqueous acidic plating bath for electrodeposition of tin, lead or tin/lead alloy comprising (a) at least one bath soluble metal salt selected from the group consisting of a stannous salt, a lead salt, or a mixture of lead and stannous salts, and (b) at least one surfactant of the formula $$ROCH_2CH(CH_3)OCH_2CH(CH_3)N(H)CH_2CH_2COOH \quad (I)$$

or $$ROCH_2CH(CH_3)OCH_2CH(CH_3)N\begin{matrix}(CH_2CH_2O)_xH\\(CH_2CH_2O)_yH\end{matrix} \quad (II)$$

wherein R is an alkyl group containing 10 to 12 carbon atoms;

x and y are integers, the sum of which is from 2 to about 20.

8. The plating bath of claim 7 wherein the bath contains fluoborate, fluosilicate, sulfate or sulfonate groups or mixtures thereof.

9. The plating bath of claim 7 wherein the bath further contains an additional component (c) comprising at least one carbonyl compound.

10. The plating bath of claim 9 wherein the carbonyl compound of component (c) is an aldehyde, ketone or carboxylic acid.

11. The plating bath of claim 9 wherein the carbonyl compound is an aromatic aldehyde or ketone.

12. The plating bath of claim 7 wherein the bath also contains (d) at least one aromatic amine.

13. An aqueous acid plating bath for electrodeposition of a tin, lead or a tin/lead alloy comprising from about 5 to about 350 grams per liter of (a) at least one metal ion selected from the group consisting of stannous ions, lead ions and mixtures thereof, from about 50 to about 500 grams per liter of at least one radical selected from the group consisting of fluoborates, fluosilicates, sulfates, sulfamates and mixtures thereof, (b) from about 0.5 to about 15 grams per liter of at least one surfactant of the formula $$ROCH_2CH(CH_3)OCH_2CH(CH_3)N(H)CH_2CH_2COOH \quad (I)$$

or $$ROCH_2CH(CH_3)OCH_2CH(CH_3)N\begin{matrix}(CH_2CH_2O)_xH\\(CH_2CH_2O)_yH\end{matrix} \quad (II)$$

wherein R is an alkyl group containing 10 to 12 carbon atoms; x and y are integers, the sum of which is from 2 to about 20, (c) from 0 to about 10 grams per liter of at least one aromatic aldehyde, and (d) from 0 to about 15 grams per liter of an aromatic amine.

14. An aqueous acidic zinc electroplating bath which comprises zinc ions, and from about 0.5 to about 15 grams per liter of (b) at least one surfactant of the formula $$ROCH_2CH(CH_3)OCH_2CH(CH_3)N(H)CH_2CH_2COOH \quad (I)$$

or $$ROCH_2CH(CH_3)OCH_2CH(CH_3)N\begin{matrix}(CH_2CH_2O)_xH\\(CH_2CH_2O)_yH\end{matrix} \quad (II)$$

wherein R is an alkyl group containing 10 to 12 carbon atoms; x and y are integers, the sum of which is from 2 to about 20.

15. The electroplating bath of claim 14 wherein the bath also contains chloride ions and boric acid.

16. The electroplating bath of claim 14 wherein the bath also contains an additional component (c) comprising at least one carbonyl-containing compound.

17. The electroplating bath of claim 16 wherein the carbonyl compound is an aromatic carbonyl compound.

18. The electroplating bath of claim 17 wherein the aromatic carbonyl compound is an aromatic aldehyde, ketone or carboxylic acid or bath-soluble salt of a carboxylic acid.

19. The electroplating bath of claim 16 wherein the bath also contains (e) at least one nonionic or cationic wetting agent.

20. An aqueous acid zinc electroplating bath comprising (a) from about 5 to about 75 grams per liter of zinc ion, from about 10 to about 75 grams per liter of boric acid, from about 50 to about 300 grams per liter of ammonium, sodium or potassium fluoride, (b) from about 1 to about 15 grams per liter of at least one surfactant of the formula $$ROCH_2CH(CH_3)OCH_2CH(CH_3)N(H)CH_2CH_2COOH \quad (I)$$

or $$ROCH_2CH(CH_3)OCH_2CH(CH_3)N\begin{matrix}(CH_2CH_2O)_xH\\(CH_2CH_2O)_yH\end{matrix} \quad (II)$$

wherein R is an alkyl group containing 10 to 12 carbon atoms; x and y are integers, the sum of which is from 2 to about 20, (c) from about 0 to about 30 grams per liter of an aromatic carbonyl-containing compound selected from a group consisting of aldehydes, ketones, acids and mixtures thereof, and (e) from 0 to about 25 grams per liter of a non-ionic or cationic wetting agent.

21. An aqueous electroplating bath for the electrodeposition of cadmium comprising (a) cadmium ions and a free acid, and (b) at least one surfactant of the formula $$ROCH_2CH(CH_3)OCH_2CH(CH_3)N(H)CH_2CH_2COOH \quad (I)$$

or $$ROCH_2CH(CH_3)OCH_2CH(CH_3)N\begin{matrix}(CH_2CH_2O)_xH\\(CH_2CH_2O)_yH\end{matrix} \quad (II)$$

wherein R is an alkyl group containing 10 to 12 carbon atoms; x and y are integers, the sum of which is from 2 to about 20.

22. The plating bath of claim 21 wherein the bath also contains (c) at least one organic brightener compound selected from the group consisting of pyridines and aromatic carbonyl-containing compounds.

23. The electroplating bath of claim 21 wherein the free acid is sulfuric acid, fluoboric acid or mixtures thereof.

24. The plating bath of claim 21 wherein the bath also contains (d) a condensed naphthalene sulfonic acid.

25. An aqueous acidic copper electroplating bath containing one or more bath-soluble copper salts, free acid, and at least one surfactant of the formula $$ROCH_2CH(CH_3)OCH_2CH(CH_3)N(H)CH_2CH_2COOH \quad (I)$$

or $$ROCH_2CH(CH_3)OCH_2CH(CH_3)N\begin{matrix}(CH_2CH_2O)_xH\\(CH_2CH_2O)_yH\end{matrix} \quad (II)$$

wherein R is an alkyl group containing 10 to 12 carbon atoms; x and y are integers, the sum of which is from 2 to about 20.

26. The plating bath of claim 25 wherein the bath also contains chloride ions.

27. The plating bath of claim 25 wherein the bath further contains an additional component (i) which comprises at least one wetting agent.

28. The plating bath of claim 27 wherein the wetting agent (i) is a polyalkylene glycol, a polyalkylene glycol ether, a composition prepared by addition of propylene oxide to ethylene diamine followed by the addition of ethylene oxide, or mixtures thereof.

29. The copper plating bath of claim 28 wherein the wetting agent (i) is a polyethylene oxide having a molecular weight of from about 400 to about 6000.

30. The method of electroplating a bright metal substrate which comprises electroplating said substrate with the electroplating bath of any one of claims 1–29.

31. An additive composition for aqueous acid metal electroplating baths comprising a mixture of (a) at least one surfactant of the formula $$ROCH_2CH(CH_3)OCH_2CH(CH_3)N(H)CH_2CH_2COOH \quad (I)$$

or $$ROCH_2CH(CH_3)OCH_2CH(CH_3)N\begin{matrix}(CH_2CH_2O)_xH\\(CH_2CH_2O)_yH\end{matrix} \quad (II)$$

wherein R is an alkyl group containing 10 to 12 carbon atoms; x and y are integers, the sum of which is from 2 to about 20, (b) an additional component which comprises at least one brightener composition which is a pyridine or a carbonyl-containing compound, and (c) a solvent.

32. The additive composition of claim 31 wherein the carbonyl compound is an aromatic carbonyl-containing compound.

33. The additive composition of claim 31 wherein the composition also contains an additional component (d) comprising at least one wetting agent.

* * * * *